US009822756B2

(12) United States Patent
Quix et al.

(10) Patent No.: US 9,822,756 B2
(45) Date of Patent: Nov. 21, 2017

(54) CYLINDER HEAD FOR AN AUTO-IGNITION ENGINE WITH DIRECT INJECTION

(71) Applicant: Ford Global Technologies, LLC, Dearborn, MI (US)

(72) Inventors: Hans Guenter Quix, Herzogenrath (DE); Klaus-Peter Heinig, Aachen (DE); Florian Huth, Aachen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 62 days.

(21) Appl. No.: 14/878,484

(22) Filed: Oct. 8, 2015

(65) Prior Publication Data

US 2016/0102629 A1 Apr. 14, 2016

(30) Foreign Application Priority Data

Oct. 8, 2014 (DE) ..... 10 2014 220 343

(51) Int. Cl.

| | |
|---|---|
| ***F02P 19/02*** | (2006.01) |
| ***F02F 1/24*** | (2006.01) |
| ***F02F 1/42*** | (2006.01) |
| ***F01B 31/14*** | (2006.01) |
| ***F02P 13/00*** | (2006.01) |
| *F02B 23/02* | (2006.01) |
| *F02B 23/06* | (2006.01) |

(52) U.S. Cl.

CPC ..... *F02P 19/026* (2013.01); *F01B 31/14* (2013.01); *F02F 1/242* (2013.01); *F02F 1/4285* (2013.01); *F02P 13/00* (2013.01); *F02P 19/02* (2013.01); *F02B 23/02* (2013.01); *F02B 23/0672* (2013.01)

(58) Field of Classification Search

CPC ..... F01B 31/14; F02P 19/00–19/028; F02D 15/00; F02D 15/04; F23Q 7/001

USPC ..... 123/179.6, 298

See application file for complete search history.

(56) References Cited

U.S. PATENT DOCUMENTS

| | | | | |
|---|---|---|---|---|
| 1,441,711 | A * | 1/1923 | Petter | F23Q 7/001 123/145 A |
| 2,872,496 | A * | 2/1959 | Chen | H01T 13/00 123/169 R |
| 4,240,392 | A * | 12/1980 | Matayoshi | F02P 19/02 123/145 A |
| 4,397,273 | A | 8/1983 | Folkerts | |
| 4,539,946 | A * | 9/1985 | Hedelin | F02D 13/0215 123/202 |

(Continued)

FOREIGN PATENT DOCUMENTS

| | | |
|---|---|---|
| DE | 7239739 U | 2/1973 |
| GB | 2217386 A | 10/1989 |
| JP | S63243461 A | 10/1988 |

*Primary Examiner* — Erick Solis
*Assistant Examiner* — Robert Werner
(74) *Attorney, Agent, or Firm* — Julia Voutyras; McCoy Russell LLP

(57) ABSTRACT

An auto-ignition engine system is provided. The auto-ignition engine system includes a cylinder having an intake valve and an exhaust valve coupled thereto, an opening in a cylinder head defining a portion of the boundary of the cylinder, a glow plug heating element extending through the opening into the cylinder, an insert at least partially surrounding a glow plug heating element and coupled thereto, and an adjustment mechanism configured to alter the position of the glow plug heating element and the insert in the cylinder.

17 Claims, 5 Drawing Sheets

(56) References Cited

U.S. PATENT DOCUMENTS

| | | | | |
|---|---|---|---|---|
| 5,195,469 | A * | 3/1993 | Syed | F02D 15/04 123/48 A |
| 5,831,376 | A * | 11/1998 | Ho | F23Q 7/10 123/145 A |
| 9,410,525 | B2 * | 8/2016 | Powell | H01T 13/30 |

* cited by examiner

CYLINDER HEAD FOR AN AUTO-IGNITION ENGINE WITH DIRECT INJECTION

CROSS REFERENCE TO RELATED APPLICATIONS

The present application claims priority to German Patent Application No. 102014220343.0, filed on Oct. 8, 2014 the entire contents of which are hereby incorporated by reference for all purposes.

FIELD

The invention relates to a cylinder head for an auto-ignition with direct injection, in particular for a motor vehicle.

BACKGROUND

Glow plugs are provided in auto-ignition engine, also referred to as compression ignition engines, to aid in heating the engine during a cold start. In the past glow plugs have been provided in pre-chambers to facilitate heating of the air fuel mixture before entering the combustion chamber. Engines have been designed to move the glow plugs in the pre-chambers to affect the airflow in the pre-chamber. However, pre-chamber engine designs have decreased combustion efficiency when compared to direct injection cylinder designs. Furthermore, the inventors have also recognized a need to vary the size of the combustion chambers in auto-ignition engines based on varying engine operating conditions.

SUMMARY

In one approach, an auto-ignition engine system is provided. The auto-ignition engine system includes a cylinder having an intake valve and an exhaust valve coupled thereto, an opening in a cylinder head defining a portion of the boundary of the cylinder, a glow plug heating element extending through the opening into the cylinder, an insert at least partially surrounding a glow plug heating element and coupled thereto, and an adjustment mechanism configured to alter the position of the glow plug heating element and the insert in the cylinder.

In this way, the volume of the combustion chamber can be significantly changed while also changing the extent to which the heating element of the glow plug protrudes into the combustion chamber. As a result, cold start operations can be improved by increasing combustion heating. Additionally, engine compression ratio can also be varied to provide desired engine output to improve fuel economy. Specifically, the insert can be actuated to increase compression ratio, during cold start for example. However, in other examples the insert can be moved independent of engine temperature. In this way, both cold start cylinder warming and variable compression ratio can be accomplished by a single device, providing dual use benefits of the glow plug unit.

BRIEF DESCRIPTION OF THE FIGURES

FIGS. 1-5 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example.

DETAILED SPECIFICATION

Figure 1:
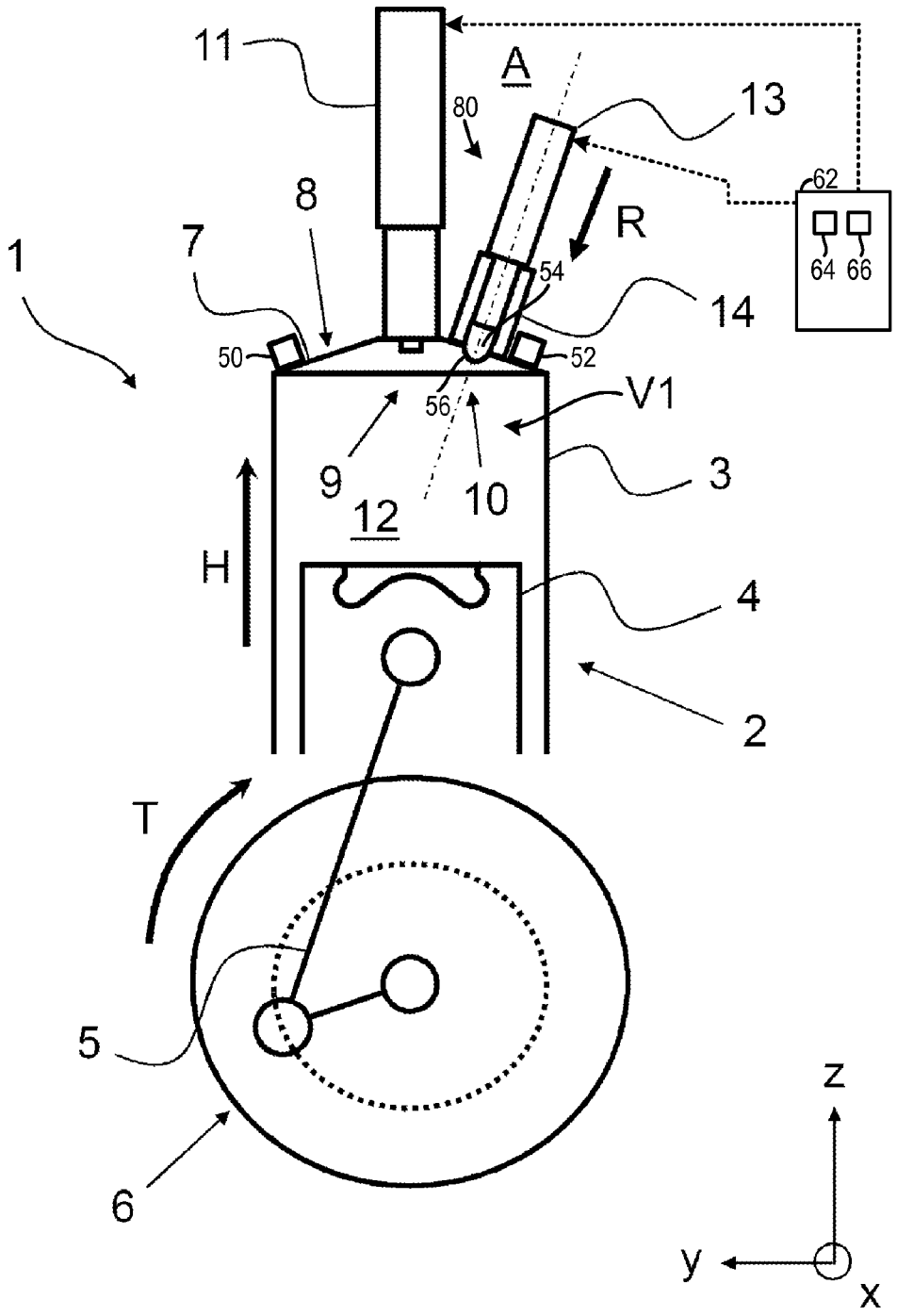
FIG. 1 shows a part of an auto-ignition engine in a section, with a view into the combustion chamber thereof.

Internal combustion engines are divided into applied-ignition engines (Otto-cycle engine) and auto-ignition engines (diesel engine). By contrast to applied-ignition engines, auto-ignition engines do not need an additional ignition source, such as for example an ignition plug, in order to ignite the fuel-air mixture for combustion. This is owing to the high compression pressures that prevail in auto-ignition engines. These lead to a temperature within the combustion chamber which is high enough to ignite the ignitable mixture generated during the injection of the fuel. Said auto-ignition thus forms the basis of the operation of diesel engines, whereas such auto-ignition is undesirable in the case of spark ignition engines, referred to as knocking.

Auto-ignition engines in turn can be divided into those with indirect injection and those with direct injection. The former are also known as pre-chamber engines, as they have a two-part combustion chamber. The latter comprises a main combustion chamber and an additional secondary combustion chamber (e.g., pre-chamber) which is assigned to the cylinder head. By contrast, in this case, too, the main combustion chamber is situated between the piston and the cylinder head. The combustion process itself begins within the pre-chamber, into which the fuel is injected and initially only partially burned. The mixture thus ignited is subsequently forced into the main combustion chamber, within which a "soft" residual combustion takes place. Diesel engines with a swirl chamber positioned upstream of the main combustion chamber additionally generate swirl of the combustion air that is forced into the swirl chamber during the compression, with fuel then being injected into said swirling combustion air. As a result, such diesel engines exhibit "harder" running.

The compression ratio of internal combustion engines can be fixedly set predominantly by way of the structural design thereof and thus by way of the engine construction itself. In this case, a certain amount of variation of the compression ratio can be highly advantageous, in particular in the case of diesel engines. Accordingly, the thus variable compression ratio can be utilized for example in order to improve the combustion process and thus reduce exhaust-gas emissions. This may be realized for example through the setting of a high compression ratio during the cold-start phase, whereas a corresponding reduction of the compression ratio may be advantageous in the presence of warm engine conditions.

JPS 63 243461 discloses a diesel engine which is operated with swirl chamber injection. In addition to at least one swirl chamber, the diesel engine has at least one associated main combustion chamber. The desired compression is typically generated by way of the stroke movement of a piston which is arranged within the cylinder of a cylinder block. The main combustion chamber is delimited by an inner surface of the cylinder and by a top side of the piston and by an underside region of a cylinder head arranged on the cylinder block. The diesel fuel is injected by way of injection nozzle into the swirl chamber of the cylinder head. In order, in particular, to permit the cold start of the diesel engine, a glow plug which protrudes at least partially into the swirl chamber is also provided. The swirl chamber is connected in fluid-conducting fashion to the main combustion chamber via a flow duct. To improve the compression ratio in the swirl chamber and reduce turbulence of the swirl caused by the glow plug protruding at least partially into the swirl chamber, it is proposed that said small glow plug heating element be arranged within the swirl chamber so as to be moveable.

Furthermore, U.S. Pat. No. 4,240,392 has disclosed the design of a glow plug for a compression-type internal combustion engine which is operated with diesel fuel and which likewise has a swirl chamber. For this purpose, the glow plug comprises an outer sleeve which is provided for arrangement in the engine block. Within the outer sleeve there is arranged a component which is displaceable relative to said outer sleeve and which is coupled to a displacement device. The component has, at an end side, a heating head with an electrical heating device which can be introduced into the swirl chamber through an open end of the outer sleeve. The displacement of the component between two end positions is intended to ensure that the heating head protrudes to an adequate extent into the swirl chamber in particular during a cold start. By contrast, said heating head should be retracted to the greatest possible extent when not being used, so as not to unnecessarily impede the swirling of the diesel fuel within the swirl chamber.

GB 2 217 386 A and U.S. Pat. No. 4,397,273 each disclose a glow plug arrangement for a diesel engine. Said glow plug arrangement comprises a pre-chamber which is situated outside a main combustion chamber of the diesel engine and which has an opening which faces toward the main combustion chamber and which connects the latter to the pre-chamber. Within the pre-chamber there is arranged a glow plug heating element which can be displaced in its longitudinal direction by way of a displacement means. In this way, the glow plug heating element can be moved back and forth between two positions. The displacement means are operated by oil pressure, which is provided by the diesel engine during the operation thereof.

Furthermore, DE 41 17 729 C1 and JPS 52 44346 A disclose a glow plug arrangement with a glow plug heating element in a precombustion chamber which permits a displacement in its longitudinal direction. In this case, DE 41 17 729 C1 is directed specifically to use in an internal combustion engine with a pre-chamber, into which the glow plug heating element can then protrude. By contrast, JPS 52 44346 presents the use of the glow plug arrangement directly in conjunction with the main combustion chamber of an internal combustion engine.

Owing to the combustion chamber being divided into two parts in the case of pre-chamber engines, it is generally the case, in relation to diesel engines without such chambers, that a larger effective surface area for the heat flow is formed, which has an adverse effect in particular in the cold-start phase of the diesel engine.

The present description is therefore not directed to pre-chamber engines of said type but to those with direct injection; that is to say correspondingly to non-pre-chamber diesel engines. Below, these will be referred to as "diesel engine" or as "diesel engine with direct injection".

Previous attempts for the variation of the compression ratio in diesel engines are in some cases complex and cannot be realized economically owing to their complexity. Moreover, known attempts have in some cases proven not to be robust. Furthermore, the compression ratio can be varied only to an insignificant extent by the displacement of previous glow plug heating elements.

In the light of the previous designs, diesel engines with variable compression ratio therefore still offer room for improvement. Against this background, it is an objective of the present description to further develop a diesel engine with direct injection, that is to say the cylinder head thereof, so as to make it possible to realize a durable and in particular economically improved system enabling a desired variation of the compression ratio.

A cylinder head and engine system having various features which enable direct injection and a displaceable glow plug are described herein.

It is pointed out that the features specified individually in the following description may be combined with one another in any desired technically meaningful way and thus discloses further refinements of the cylinder head and engine system.

Accordingly, below, a cylinder head for a diesel engine with direct injection will be presented which is suitable in particular for use in or on a motor vehicle. For this purpose, the cylinder head may include a main body which has at least one opening for an injection valve (injector) and at least one receiving region for a glow plug. The injection valve, which can at least partially be mounted through the opening, is provided for injecting an amount of diesel fuel into a combustion chamber of the diesel engine, in particular when the cylinder head is in the installed state. In this case, the glow plug is provided in particular for heating the combustion chamber as desired. This may be desired for example at the commencement of or during a cold-start phase of the diesel engine equipped with the cylinder head described herein. It is possible for the glow plug to also contribute to the heating the compression ignition engine (e.g., diesel engine) as desired during the operation of the compression ignition engine, where this is desired and/or expedient.

In one example, the cylinder head has an insert arranged in the receiving region of its main body. In this case, said cylinder head is arranged in or on the receiving region such that the insert is displaceable relative to the main body of the cylinder head. For this purpose, the insert is designed and/or mounted so as to permit its linear displaceability relative to the main body of the cylinder head. The insert serves for at least partially receiving the glow plug, such that said glow plug, when connected or coupled to the insert, is correspondingly jointly linearly displaceable.

The thus linearly displaceable insert, and in particular the unit that can be formed by the insert and glow plug, have the result that the volume of the engine equipped with the cylinder head described herein can be varied. For this purpose, the engine may have at least one cylinder which, in combination with a piston arranged movably therein and the cylinder head, provides a combustion chamber. In this case, the volume of the combustion chamber is at least partially delimited, toward one opening side of the cylinder, by the piston, and toward the opposite opening side, by at least one region of the main body of the cylinder head. Thus, the insert also serves to vary the size of the combustion chamber, therefore the size and geometry of the insert may be sized such that it decreases the size of the combustion chamber by a desired amount.

The advantage that arises from this lies initially in the resulting ability to vary the volume of the combustion chamber, and thus the compression ratio, of the auto-ignition engine that can be thus equipped, both outside and during the operation thereof. The change in position of just one part of the components which delimit the combustion chamber in particular in the compressed state is sufficient to vary the volume thereof. Said compressed state may be attained when the piston reaches its top dead center within the cylinder.

A linear displacement restricted only to the glow plug heating element itself could make only a small and thus non-expedient contribution to a decisive variation in the volume of the combustion chamber and thus of the compression ratio. This is based substantially on the diameter of the glow plug being small in relation to the volume, and the largest possible displacement of said glow plug. In particular, an increase of the compression ratio by a desired amount that said glow plug has to be displaced, in particular pushed, into the combustion chamber or at least further in the direction thereof. The only small remaining distance between the main body of the cylinder head and the piston however does not permit a large displacement of the glow plug in this case. Accordingly, an excessively large displacement would inevitably lead to contact between the piston and glow plug, which could lead to the destruction thereof, resulting in major engine damage.

Here, the combination of insert and glow plug is decisively conducive to considerably increasing the linearly displaceable material volume made up of these. Owing to the thus enlarged displaceable material volume, the capacity of the combustion chamber can be varied, in particular reduced, with considerably greater effectiveness. In this case, said material volume may be defined at least by the product of the outer diameter of the insert and the displacement travel thereof. As a result, a considerably greater variation of the otherwise structurally predefined compression ratio is made possible.

In particular, the insert may be dimensioned in accordance with the extent of the cylinder displaceability. In this case, an only small degree of desired displaceability correspondingly large dimensions for the insert in order to realize a desired variation of the combustion chamber volume. By contrast, the insert may have smaller dimensions if a correspondingly greater degree of displaceability is desired. In this respect, the insert may be dimensioned on the basis of the respective structural conditions and/or the desired variation of the compression ratio and/or the largest possible displaceability of the insert.

The refinement which is directed to purely linear displaceability enables simple sealing of the insert with respect to the main body of the cylinder head. Suitable sealing component may be selected for example on the basis of the prevailing pressures and the individual contact surface on the one or more sealing component. The at least one sealing component may for example be formed from a soft seal. A purely metallic seal is also conceivable. Furthermore, a fluid pressure may prevail within the gap to be sealed in order to permit or support the desired sealing action with respect to the compression pressure.

It is furthermore provided that the insert is displaceable between at least two positions; that is to say a first position and a second position. Displaceability with intermediate stages, and/or continuously variable displaceability, are also conceivable. In the present case, positions may be considered to be the extreme positions between which the insert is variable in terms of its position to its largest extent. However, numerous displacement positions have been contemplated.

The displaceability between said two positions is provided for effecting a variation in the volume of the combustion chamber, which leads to a corresponding variation of the compression ratio of the auto-ignition engine. Accordingly, a second compression ratio based on the volume of the combustion chamber in the second position may be higher than a first compression ratio based on the volume of the combustion chamber in the first position. Accordingly, the first position may be a so-called normal position of the insert, whereas the second position refers to the displacement thereof toward the combustion chamber. In other words, the volume of the combustion chamber may be reduced in the second position of the insert, whereby the compression ratio of the auto-ignition engine is then increased.

In an advantageous further development, it is furthermore possible for a displacement arrangement to be provided in order to realize the linear displaceability of the insert together with the glow plug. The displacement arrangement may for example be purely mechanically operated. Alternatively or in addition to this, a correspondingly designed hydraulic and/or pneumatic drive is also conceivable.

In one example, the displacement arrangement may include a knee lever which is substantially made up of two limbs which are connected (e.g., connected in an articulating manner) to one another. The two limbs may be coupled to one another by way of an intermediate joint. The intermediate joint may be connected to an actuator in order to directly or indirectly permit the linear displacement of insert and/or glow plug.

In a further development, the displacement arrangement may for example alternatively or additionally have a thread. Said thread is provided for converting a rotational movement into a translational movement, such that a linear displacement of the insert in or counter to an intended displacement direction is made possible.

The cylinder head described above enables the compression ratio of an auto-ignition engine with direct injection and equipped with said cylinder head to be varied to an adequate extent. Contrary to the prior art, for this purpose, the engine described herein provides not a displacement which is restricted to the glow plug alone, but a displacement of said glow plug in combination with the insert that bears the glow plug. In particular, the combination, provided for this purpose, of insert and glow plug is decisively conducive to providing a durable and in particular economically improved solution in relation to previous engine designs, if desired.

In another example, an auto-ignition engine with direct injection, which auto-ignition engine has at least one cylinder head. The cylinder head may be a cylinder head as described above. Furthermore, the cylinder head may include a main body which has at least one opening with an injection valve (injector) provided therein and at least one receiving region with a glow plug provided therein.

In another example, the cylinder head of the auto-ignition engine has an insert which is arranged in the receiving region and in which the glow plug is at least partially received. In this case, the opening where the glow plug is arranged on or in the insert, and connected thereto, at least in regions. The connection between the insert and glow plug may be a releasable connection. It is alternatively conceivable that the insert and glow plug may, by contrast, form an inseparable unit which can be replaced as a whole unit, if desired.

In accordance with this, an embodiment of a glow plug would also be conceivable, the body of which may itself have a corresponding formation for example in the form of a thickening and/or widening, which is to be regarded in the sense of an insert. In relation to previous glow plugs, said formation could have correspondingly larger dimensions, which can be attributed in particular to the arrangement of the insert. Accordingly, the insert may be a component which is separate from the glow plug. Alternatively, the insert may also be a materially integral constituent part of the glow plug. As a further alternative, the insert may also be a means for mounting in and/or sealing with respect to the receiving region of the cylinder head.

In another example, the insert together with the glow plug is displaceable relative to the main body such that a volume, which is at least partially delimited by the main body, of a combustion chamber of the auto-ignition engine can be varied. In this way, the otherwise structurally fixed compression ratio can be correspondingly varied.

The resulting advantages have been explained above in conjunction with the cylinder head described herein and apply correspondingly to an auto-ignition engine equipped in a motor vehicle. This moreover also applies to the further advantageous designs of the auto-ignition engine described herein. For this reason, at this juncture, reference is made to the statements made above in their entirety.

Where the present description refers to the linear displacement of the insert, this relates to the combination of the insert and of the glow plug connected thereto. However, in other examples another insert may be provided separate from the glow plug.

In one example, the insert may be displaceable, in particular together with the glow plug, in a manner dependent on an operating temperature of the auto-ignition engine. For example, in a cold-start phase of the auto-ignition engine, the insert can be displaced into the second position, whereby an advantageous higher compression ratio is set. By contrast, in those phases in which the auto-ignition engine is at a relatively high, in particular at least normal, operating temperature, the insert can be displaced back into the first position, in the sense of an initial position. In this way, it would be possible for the previously still increased compression ratio to the changed to the normal compression ratio again. Thus, simple sealing of the combustion chamber in structural terms can be implemented even in the presence of relatively high loads of the auto-ignition engine and correspondingly high cylinder pressure.

Alternatively or in addition to this, the insert may also be displaceable, in particular together with the glow plug, in a manner independent of the respective operating temperature of the auto-ignition engine. Accordingly, the displaceability of the insert may for example, in a manner dependent on or independent of the respective operating temperature, be utilized for improving the position of the glow plug. Said improvement may be performed in the cold-start phase of the auto-ignition engine. In any case, it may be advantageous under certain conditions to vary, in particular increase, the compression ratio even when the auto-ignition engine has correspondingly warmed up. Thus, the insert may be moved into the combustion chamber by a greater extent when the glow plug heating element is not heating the combustion chamber. In this way, the glow plug unit can be used to vary combustion chamber volume when the glow plug is not being operated to heat the engine.

Furthermore, a method for operating an auto-ignition engine which has direct injection is also described herein. In this case, the auto-ignition engine has a cylinder head, which may be a cylinder head as specified above. The cylinder head may include a main body which has at least one opening with an injection valve (injector) provided therein and at least one receiving region with a glow plug provided therein. The injection valve is provided for supplying fuel (e.g., diesel or biodiesel fuel) to the auto-ignition engine. Accordingly, during operation, an amount of fuel is injected by the injection valve into a combustion chamber of the auto-ignition engine. By contrast, the glow plug is provided for increasing a temperature, wherein the at least one combustion chamber is heated by the glow plug as desired either during the starting of the auto-ignition engine or even before the starting thereof.

In one example, an insert is provided which is arranged in the receiving region and which at least partially accommodates the glow plug. In order to now vary the volume of the combustion chamber of the auto-ignition engine even before starting or during the starting and/or operation thereof, the insert is displaced linearly relative to the main body. The insert may be displaced together with the glow plug.

The resulting advantages have already been explained above in conjunction with the cylinder head described above and apply correspondingly to the method described herein.

In one example, the insert can be displaced, in particular together with the glow plug, in a manner dependent on the operating temperature of the auto-ignition engine. In another example, the insert may be also displaced, in particular together with the glow plug, in a manner independent of the operating temperature of the auto-ignition engine.

FIG. 1 schematically shows a section through an auto-ignition engine 1 (e.g., diesel engine), in one example. FIG. 1 shows a cylinder block 2 which extends into and out of the plane of the drawing in a longitudinal direction x and which includes a cylinder 3. A piston 4 is arranged within the cylinder 3, wherein the piston 4 is guided within the cylinder 3 with respect to the longitudinal direction x and a transverse direction y. By contrast, the piston 4 is movable upward and downward in a vertical direction z of the cylinder 3.

The piston 4 is connected by way of a connecting rod 5 to a crankshaft 6 which extends in the longitudinal direction x, in such a way that a linear stroke movement H of the piston 4 can, in the desired manner, be converted into a rotational movement T of the crankshaft 6.

Furthermore, the cylinder block 2 and thus also the cylinder 3 are bounded, at their upper ends as viewed in the vertical direction z, by a cylinder head 7. The cylinder head 7 has a main body 8 which has at least one opening 9 and a receiving region 10. An injection valve 11 in the form of an injector is arranged through the opening 9 of the main body 8 in such a way that, through use of the injection valve 11, an amount of fuel (e.g., diesel, biodiesel, etc.,) can be injected into a combustion chamber 12 of the auto-combustion engine 1. By contrast, the receiving region 10 serves for the mounting of a glow plug 13 which is arranged in or through said receiving region. The glow plug 13 is provided in particular for heating the combustion chamber 12 of the auto-ignition engine 1 in accordance with demand, if desired.

As described herein, the cylinder head 7 furthermore includes an insert 14 arranged in or on the receiving region 10. The insert 14 is designed for at least partially receiving the glow plug 13 within it. For this purpose, the insert 14 may for example have a corresponding bore in which the glow plug 13 is arranged. In this case, the insert 14 is designed and/or mounted so as to be displaceable in a displacement direction R relative to the main body 8 of the cylinder head 7. In this way, a volume of the combustion chamber 12, which volume is delimited at least partially by the main body 8 of the cylinder head 7 in the vertical direction z, can be varied. In the position illustrated in FIG. 1, the glow plug unit 80 composed of insert 14 and glow plug 13 is situated in a first position A, in which a first compression ratio V1 of the auto-ignition engine 1 is realized. The first compression ratio V1 may for example be 16.5:1. However, other compression ratios have been contemplated. As shown, the glow plug unit 80 is adjacent to the injection valve 11. Placing the glow plug unit 80 near the injection valve 11 enables the unit to extend into the combustion chamber 12 be a greater amount when actuated when compared to other locations closer to the bottom of the combustion chamber.

An intake valve 50 and exhaust valve 52 are coupled to the cylinder 3. The intake valve 50 is configured to selectively flow (e.g., enable/inhibit) intake gas into the cylinder 3 from an intake system. On the other hand, the exhaust valve 52 is configured to selectively flow exhaust gas to an exhaust system. The timing of the intake and the exhaust valve may be adjusted by a controller 62, in one example. Although the intake valve 50 is illustrated as being positioned adjacent to the glow plug 13 and the exhaust valve 52 is illustrated as being positioned away from the glow plug 13 numerous alternate intake and exhaust valve positions have been contemplated. Moreover, more than one intake valve and/or exhaust valve may be included in the auto-ignition engine 1.

The auto-ignition engine 1 also includes a control system 60 which may be more generally referred to as an auto-ignition engine system. The control system 60 includes a controller 62. The controller 62 includes code stored in memory 64 executable by a processor 66. The controller 62 may be configured to implement the method for varying engine compression ratio via the displacement of the glow plug unit described herein.

Figure 2:
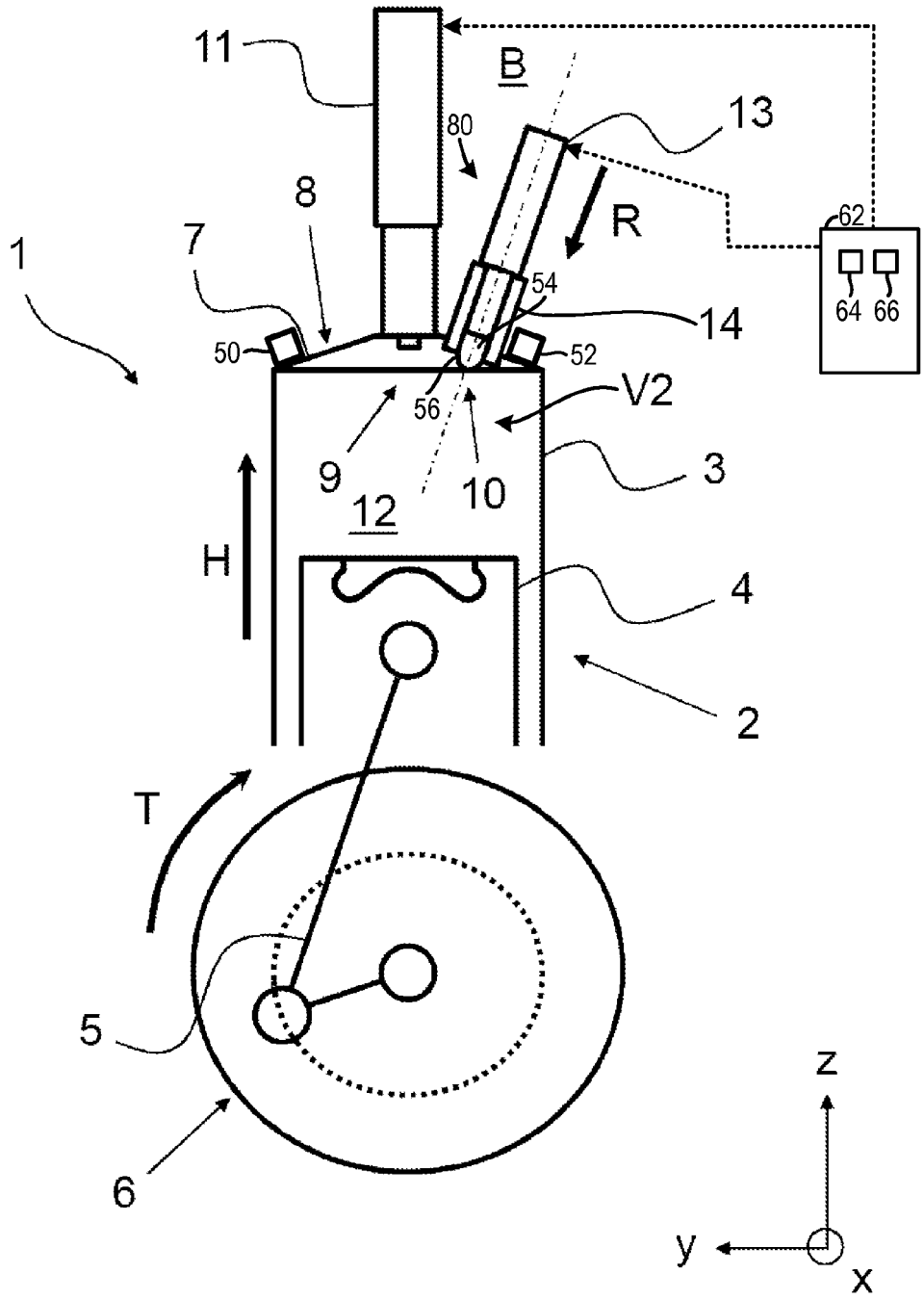
FIG. 2 shows the auto-ignition engine from FIG. 1 in the same form of illustration but with one of the components thereof in a changed position.

FIG. 2 shows the displaced state of the insert 14 together with the glow plug 13, wherein these have, as the glow plug unit 80, been displaced in the displacement direction R toward the combustion chamber 12. In this case, said unit composed of insert 14 and glow plug 13 has assumed a second position B, in which a second compression ratio V2 of the auto-ignition engine 1, which is changed in relation to the first compression ratio V1, is realized. This is a result of the now changed volume of the combustion chamber 12, which has now been reduced in size by the displaced unit composed of insert 14 and glow plugs 13. The second compression ratio V2 that is now set may for example be 17:1. However, alternate changes in the compression ratio of the engine have been contemplated.

FIGS. 1 and 2 also show the glow plug 13 is arranged off axis from the injection valve 11. As shown, the injection valve 11 is arranged centrally with regard to the x-axis and the y-axis. However, the injection valve 11 may not be centrally arranged, in other examples. For instance, the injector valve 11 may be adjacent to the intake valve 50 or the exhaust valve 52.

The glow plug 13 also includes a glow plug heating element 54. The insert 14 may at least partially circumferentially surround the glow plug heating element 54. Specifically in the depicted example, the insert 14 circumferentially surrounds the glow plug heating element 54.

Additionally, the insert 14 may be constructed out of different materials than the glow plug heating element 54. For instance, the glow plug heating element 70 may include an electrically conductive material embedded in a ceramic portion (e.g., ceramic rod) and the insert 14 may be constructed out of a metallic material and/or a ceramic material.

The insert 14 is axially offset from the glow plug heating element 54. That is to say that the insert 14 does not extend to an end 56 of the glow plug heating element 54 positioned in the cylinder 3. In this way, the insert 14 does not impede heating of the cylinder 3 during operation of the glow plug heating element 54. However other insert geometries have been contemplated.

Figure 3:
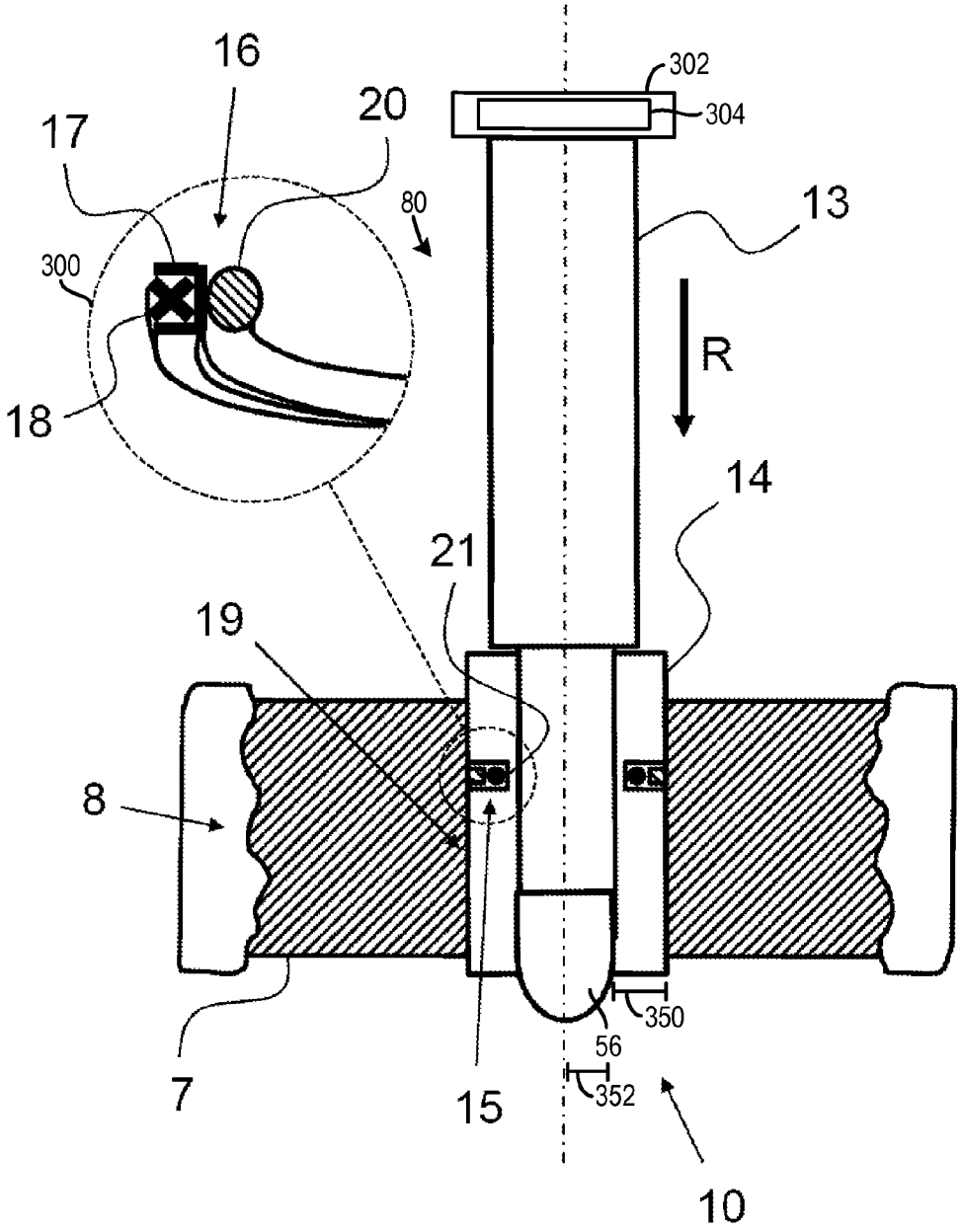
FIG. 3 shows a detail of a component of the auto-ignition engine from FIGS. 1 and 2.

FIG. 3 shows the insert 14 together with the glow plug 13 in an enlarged detail of the cylinder head 7 in the region of the receiving region 10 of the main body 8. To realize the desired sealing action between the insert 14 and main body 8, the insert 14 has, in the present case, an encircling annular groove 15 into which a suitable sealing component 16 is inserted. The sealing component 16 that can be used in the context of this description may also be used in the hydraulic sector. The criteria for the selection of suitable sealing component 16 may be the resistance to and suitability for the expected or prevailing temperatures and pressures.

For better illustration, the sealing component 16 shown here is shown on an even larger scale in a perspective sectional illustration within the circle, indicated by a dashed line 300.

The sealing component 16 that are shown here is a double-acting, pre-stressed rubber seal. The latter comprises a sealing ring 17 which is of U-shaped cross section and into which there is placed a further, additional seal 18 which is of X-shaped cross section. In this way, the additional seal 18 is arranged between the two limbs of the sealing ring 17. Owing to the arrangement and cross-sectional geometry of the sealing ring 17 and in particular of the additional seal 18, it is achieved that there is only low friction relative to a wall 19 of the receiving region 10 of the main body 8 in and counter to the displacement direction R. The pre-stress, which in particular causes the additional seal 18 to bear against the wall 19, is generated by an elastomer O-ring 20 which, for this purpose, is supported relative to a groove base 21 of the annular groove 15.

The definition of the dimensions of the annular groove 15 as installation space for the sealing component 16 may be selected based on installation needs for different engines. For example, to manufacturer's specifications and/or corresponding standards such as, for example, ISO 7425. The annular groove 15 may also be arranged in the receiving region 10 within the main body 8 of the cylinder head 7, such that in particular, the additional seal 18 can be supported against the outer circumference of the insert 14.

FIG. 3 shows an actuation mechanism 302 included in the glow plug unit 80. In one example, the actuation mechanism 302 may include a thread 304, the thread being arranged and designed so as to convert a rotational movement into a translational movement directed in or counter to a displacement direction. Thus, the actuation mechanism 302 can rotate the thread 304 to extend and retract the insert 14 along with the glow plug heating element 56. However, other types of actuation mechanisms have been contemplated, such as the knee lever described herein with regard to FIG. 4.

The radial thickness 350 of the insert 14 may be larger than or equal to the radius 352 of the glow plug heating element 54, in one example. In this way, the insert 14 may be sized to decrease the size of the combustion chamber by a desired amount that enables the combustion volume to be significantly impacted to provide a reduction in engine fuel consumption.

Figure 4:
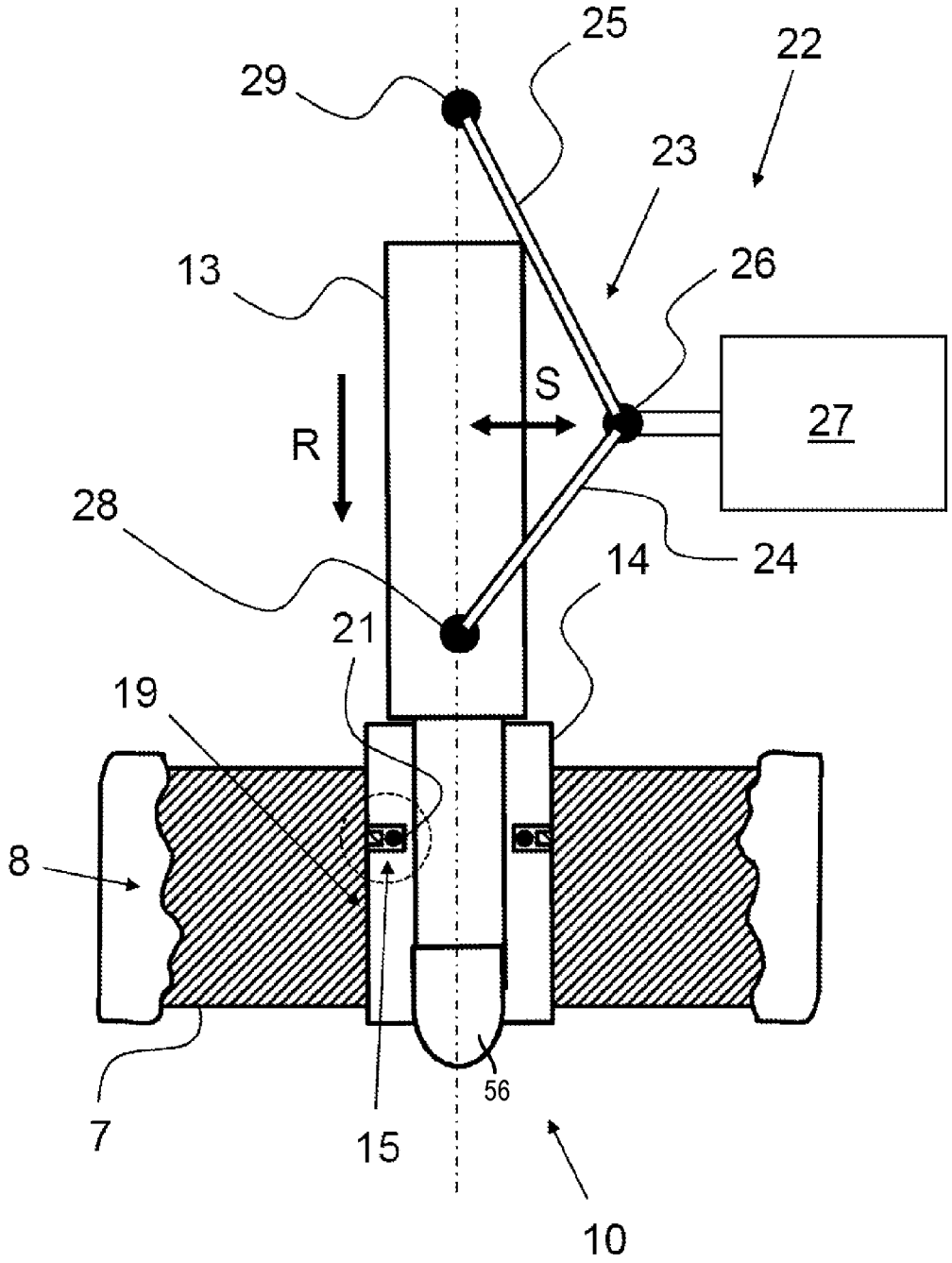
FIG. 4 shows a detail from FIG. 3 in combination with a compression ratio-arrangement.

FIG. 4 shows a possible displacement arrangement 22 (e.g., actuation mechanism) for realizing the linear displaceability of the insert 14 together with the glow plug 13. As can be seen, the displacement arrangement 22 comprises, in the present case, a knee lever 23 which is substantially made up of two limbs 24, 25 which are connected to one another. The two limbs 24, 25 are coupled to one another by means of an intermediate joint 26, wherein the intermediate joint 26 is connected to an actuator 27.

A lower limb 24 of the knee lever 23 as seen in the illustration of FIG. 4 is coupled at its free end to the glow plug 13 by way of a lower joint 28. By contrast, the remaining upper limb 25 has an upper joint 29 which is situated at its free end and which may be connected, in a manner not shown in any more detail, to the cylinder head 7 or other positionally fixed components. Since the upper limb 25 of the knee lever 23 rotates about the upper joint 29 and is otherwise held stationary, an adjustment in the movement direction S by the actuator 27 is converted into a displacement of the insert 14 together with the glow plug 13 in or counter to the displacement direction R.

Owing to the transmission of force being realized by the knee lever 23, a corresponding adjustment can be performed even in the presence of high pressure. At the same time, the actuator which is used can be of correspondingly small dimensions with regard to its power, which ultimately also has a positive effect on the structural dimensions thereof (small installation dimensions,) if desired.

As a further alternative mechanical displacement arrangement 22, it would for example be conceivable to use a thread, by which a rotational movement could be converted into the desired translational movement in or counter to the displacement direction R, as discussed above with regard to FIG. 3. Additionally, it is possible for the adjustment of the insert 14 and glow plugs 13 to be realized via a hydraulic actuation mechanism, for example. In such an example, it would be possible to use the oil pressure that prevails while the auto-ignition engine 1 is running to drive the hydraulic actuation mechanism, in one example.

Figure 5:
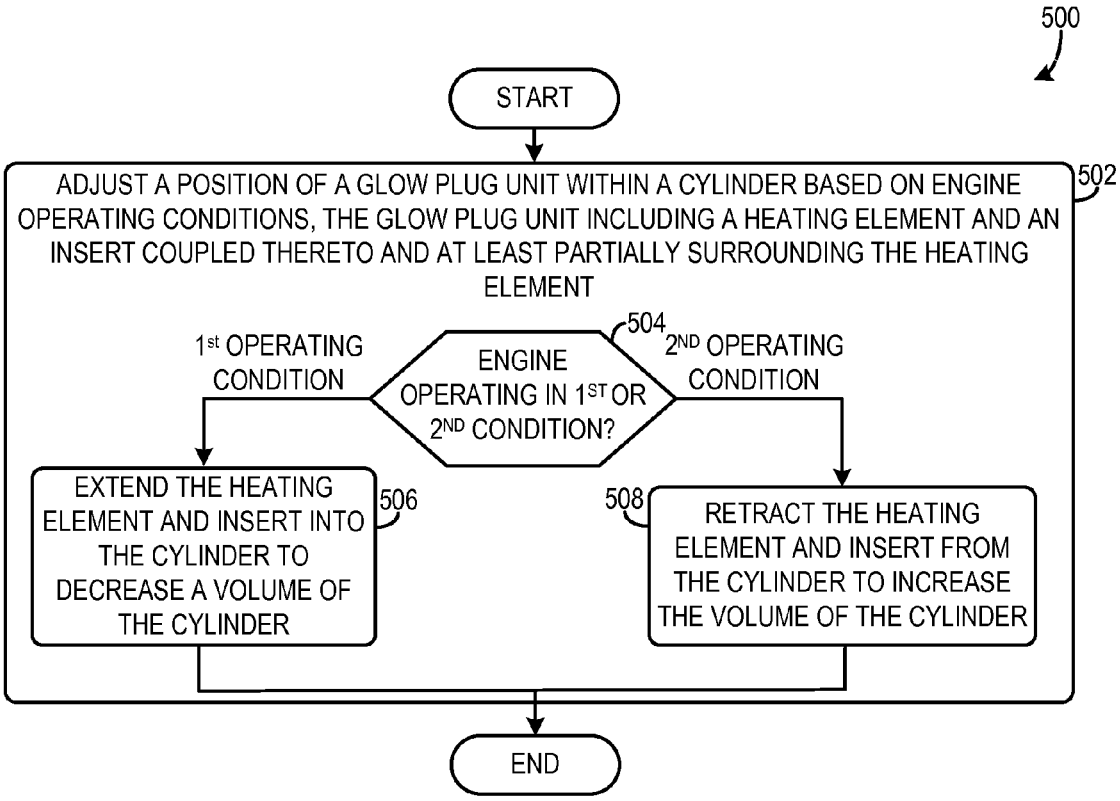
FIG. 5 shows a method for operating an engine system.

FIG. 5 shows a method 500 for operating an auto-ignition engine. The method 500 may be implemented by the auto-ignition engine and engine systems described above with regard to FIGS. 1-4 or may be implemented by another suitable auto-ignition engine and engine systems.

At 502 the method includes adjusting a position of a glow plug unit within a cylinder based on engine operating conditions, the glow plug unit including a heating element and an insert coupled thereto and at least partially surrounding the heating element Adjusting the cylinder position may include steps 504-508. At 504 the method determines if the engine is operating under the $1^{st}$ or $2^{nd}$ operating condition. If the engine is operating under the $1^{st}$ operating condition the method progresses to step 506. At 506 the method includes, during the $1^{st}$ operating condition, extending the heating element and insert into the cylinder to decrease a volume of the cylinder. However, if the engine is operating under the $2^{nd}$ operating condition the method progresses to step 508. At 508 the method includes, during the $2^{nd}$ operating condition, retracting the heating element and insert from the cylinder to increase the volume of the cylinder.

In one example, the first operating condition is when the engine temperature is below a threshold value and the second operating condition is when the engine temperature is above the threshold value. However, other $1^{st}$ and $2^{nd}$ engine operating conditions have been contemplated. Further in one example, the cylinder position of the glow plug heating element and the insert can be adjusted while the glow plug heating element is not active. That is to say, the position of the glow plug heating element and insert can be adjusted when the heating element is not driven to warm the combustion chamber, in one example. In this way, the combustion chamber volume can be varied to reduce fuel consumption during desired periods and independent of heating element operation.

Further in another example, the glow plug unit may be operated to provide heat to the combustion chamber during a cold start. Further in such an example, the glow plug unit can also be operated to vary the engine's compression ratio after engine warm up. Varying the engine's compression ratio can include extending the glow plug unit into the combustion chamber when a desired engine output is less than a threshold value and retracting the glow plug unit from the combustion chamber when the desired engine output is greater than a threshold value. As previously discussed, the compression ratio may be varied by the glow plug unit when the glow plug unit is not providing engine heating.

Note that the example control and estimation routines included herein can be used with various engine and/or vehicle system configurations. The control methods and routines disclosed herein may be stored as executable instructions in non-transitory memory and may be carried out by a control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily needed to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller. Exemplary valve actuators include electro-mechanical actuators coupled to a valve to adjust the valve in an open or closed configuration, passive valve actuators such as a check valve, etc. The valves also may be pneumatically or hydraulically actuated, in some examples.

The invention claimed is:

1. A cylinder head for an auto-ignition engine with direct injection, in a motor vehicle, comprising:

a main body which has at least one opening for an injection valve and at least one receiving region for a glow plug, the main body including:

an insert which is arranged in the receiving region between an intake valve and an exhaust valve and which is provided for at least partially surrounding the glow plug and which is linearly displaceable toward a piston relative to the main body such that a volume of a combustion chamber of the auto-ignition engine is selectively varied, the insert being displaceable between a first position and a second position where, in the second position, an end of the glow plug is positioned further into an interior of the combustion chamber toward the piston than the injection valve, and a second compression ratio based on the volume of the combustion chamber in the second position being higher than a first compression ratio based on the volume of the combustion chamber in the first position, where the insert is displaceable via an adjustment mechanism configured to alter a position of the glow plug heating element and the insert between the first and second positions in the cylinder, the adjustment mechanism including a knee lever which has two limbs which are connected to one another by way of an intermediate joint, the intermediate joint being connected to an actuator.

2. The cylinder head as claimed in claim 1, where the injection valve is positioned between the intake valve and the exhaust valve, and where the insert is displaceable together with the glow plug in a manner dependent on an operating temperature of the auto-ignition engine.

3. The cylinder head as claimed in claim 1, where the insert is displaceable together with the glow plug in a manner independent of an operating temperature of the auto-ignition engine.

4. The cylinder head as claimed in claim 1, where the displacement arrangement has a thread, the thread being arranged and designed so as to convert a rotational movement into a translational movement directed in or counter to a displacement direction.

5. An auto-ignition engine system comprising:

a cylinder having an intake valve and an exhaust valve coupled thereto;

an opening in a cylinder head defining a portion of a boundary of the cylinder;

a glow plug heating element extending through the opening into the cylinder;

an insert at least partially surrounding the glow plug heating element and coupled thereto; and an adjustment mechanism configured to alter a position of the glow plug heating element and the insert in the cylinder, the adjustment mechanism including a knee lever which has two limbs which are connected to one another by way of an intermediate joint, the intermediate joint being connected to an actuator.

6. The auto-ignition engine system of claim 5, where a radial thickness of the insert is greater than or equal to a radius of the glow plug heating element.

7. The auto-ignition engine system of claim 5, further comprising a controller configured to actuate the actuator to alter the position of the glow plug heating element and the insert in the cylinder based on engine operating conditions, including adjusting a longitudinal position of the glow plug heating element and the insert.

8. The auto-ignition engine system of claim 7, where the controller is configured to adjust the longitudinal position of the glow plug heating element and the insert while the glow plug heating element is not active.

9. The auto-ignition engine system of claim 7, where the controller is configured to adjust the longitudinal position by extending and retracting the glow plug heating element and the insert in the cylinder.

10. The auto-ignition engine system of claim 9, where the glow plug heating element and the insert are extended into the cylinder when an engine temperature is below a threshold value and the glow plug heating element and insert are retracted from the cylinder when the engine temperature is above the threshold value.

11. A method for operating an engine system comprising:

adjusting a position of a glow plug unit within a cylinder based on engine operating temperature, the glow plug unit including a heating element and an insert coupled thereto and at least partially surrounding the heating element, where the adjusting further includes an adjustment mechanism configured to alter a position of the glow plug unit and the insert in the cylinder, the adjustment mechanism including a knee lever which has two limbs which are connected to one another by way of an intermediate joint, the intermediate joint being connected to an actuator, including:

responsive to the engine operating temperature being below a threshold temperature, extending the glow plug unit from a first position to a second position, and in the second position, an end of the glow plug unit extends further into an interior of a combustion chamber than in the first position; and responsive to the engine operating temperature being above the threshold temperature, retracting the glow plug unit from the second position to the first position.

12. The method of claim 11, where extending the glow plug unit includes extending the heating element and insert into the cylinder to decrease a volume of the cylinder and wherein retracting the glow plug unit includes retracting the heating element and insert from the cylinder to increase a volume of the cylinder.

13. The method of claim 11, where adjusting the position of the glow plug unit comprises adjusting a longitudinal position of the heating element and the insert while the glow plug heating element is not active.

14. The cylinder head as claimed in claim 1, further comprising a sealing component housed in an encircling annular groove of the insert.

15. The cylinder head as claimed in claim 14, wherein the sealing component comprises a first sealing ring, a second sealing ring having a u-shaped cross-section, and a third sealing ring having an x-shaped cross-section, the first sealing ring coupled between a groove base of the annular groove of the insert and the second sealing ring.

16. The method of claim 11, wherein extending the glow plug unit from the first position to the second position comprises actuating the adjustment mechanism, and where the knee lever is coupled to the glow plug unit.

17. The method of claim 11, further comprising combusting fuel in the cylinder, the fuel supplied by a fuel injector of the cylinder, and wherein extending the glow plug unit from the first position to the second position comprises extending the glow plug unit from the first position, past a tip of the fuel injector, to the second position.

* * * * *